US005556166A

United States Patent [19]

Synnestvedt

[11] Patent Number: 5,556,166

[45] Date of Patent: Sep. 17, 1996

[54] RECLINING BRACKET LOUNGE CHAIR

[75] Inventor: Blake Synnestvedt, Tempe, Ariz.

[73] Assignee: Desert Craft Casual Furniture Co., Tempe, Ariz.

[21] Appl. No.: 406,037

[22] Filed: Mar. 16, 1995

[51] Int. Cl.[6] ..... B60N 2/02

[52] U.S. Cl. ..... 297/377; 297/452.2; 297/463.1

[58] Field of Search ..... 297/354.13, 354.12, 297/354.1, 353, 463.1, 377, 452.18, 452.2

[56] References Cited

U.S. PATENT DOCUMENTS

| | | | |
|---|---|---|---|
| 1,902,249 | 3/1933 | Lanzy | 297/377 X |
| 2,728,376 | 12/1955 | Halde | 297/377 X |
| 4,684,170 | 8/1987 | Colby | 297/440.11 X |
| 5,297,850 | 3/1994 | Guleserian | 297/377 |
| 5,427,435 | 6/1995 | Yoder, Jr. | 297/452.2 X |

OTHER PUBLICATIONS

Texcraft Style 1995 Catalogue "Manufacturing Fine Casual Indoor and Outdoor Furnishings", front cover page, p. 31 and back cover page.

TROPITONE Contract 1994–1995 catalogue "Classic Designs for Casual Living", front cover page, catalogue page and back cover page.

*Primary Examiner*—Milton Nelson, Jr.

*Attorney, Agent, or Firm*—Synnestvedt & Lechner

[57] ABSTRACT

A lounge chair having a pivotally mounted back support includes fittings providing vertical offsets in the side frame members sufficient to provide a clearance space between the frame of the back and the side frame members when the back support is moved to the fully reclined position. The clearance space is sufficient to prevent pinching of the fingers of the user of the chair when the back support is reclined.

5 Claims, 2 Drawing Sheets

RECLINING BRACKET LOUNGE CHAIR

FIELD OF THE INVENTION

This invention relates to lounge chairs having a back support adjustably movable between a generally upright position and a substantially horizontal reclining position and, more particularly, to a chair having a frame provided with offset means for avoiding pinching of the fingers of the user of the chair when the back is moved from an upright position to a fully reclined position.

BACKGROUND OF THE INVENTION

Typically, fabricated lounge chairs of the type to which this invention relates are comprised of tubular frame and support members and an adjustable back support pivotally mounted to the frame members so that the back support can be moved from an upright position to a substantially horizontal position. Typically, this is accomplished by a rachet device pivotally mounted to the back support and interengageable with a cross-piece on the frame at a plurality of fixed positions. When the rachet device is in one extreme position, the back is in a generally horizontal position with the side frame members of the back parallel to and substantially in contact with the side frame members of the chair. Such chairs have been in use for many years and have given generally satisfactory service.

One problem which occurs with such chairs is that the fingers of the user may become pinched between the side frame members of the base or seat portion or the side frame members of the back support when someone sitting on the chair reaches back in an attempt to ease the back support from the raised to the horizontal position. Known ways of dealing with this problem involve either bending the side frame members downwardly underneath the back support so that a space is created when the back support is in the reclined position so that the fingers are not as likely to be pinched.

Another known way of dealing with the problem involves making the back support narrower than the seat portion, likewise creating a space. This creates an unacceptably narrow back or an unacceptably wide base or seat portion.

SUMMARY AND OBJECTS OF THE INVENTION

According to the invention, a novel frame construction is provided for a lounge chair with a reclinable back vertically offset from each other at a location in which adjacent frame sections are adjacent the hinge axis for the back support so as to create a spacing between the back support and the hinge which eliminates pinching of the fingers of the user of the chair and strengthens the hinge construction. This is accomplished by use of side frame members which are each subdivided into a first raised portion at one end of the chair and a second lowered portion at the end underneath the back support. Each of the separate side frame portions include receptacles facing generally towards each other for the purpose of connection to a fitting having one of a pair of axially extending projections disposed on axes parallel to one another and extending in opposite directions. Hinge means for the back support comprises pivot pins which pass through the receptacles of the first raised portions and through the projections secured within the projections. Preferably, the offset projections are provided in the form of a cast fitting and the offset distance between the projections is such that a clearance space exists between the frame of the back support and the lower side frame portions which is sufficient to prevent injury to the fingers of the user of the chair as the back support is moved from an upright position to the reclined position.

BRIEF DESCRIPTION OF THE DRAWINGS

Reference is now made to the drawings illustrating a preferred embodiment of the invention in which.

DETAILED DESCRIPTION OF THE PREFERRED EMBODIMENT OF THE PRESENT INVENTION

Figure 1:
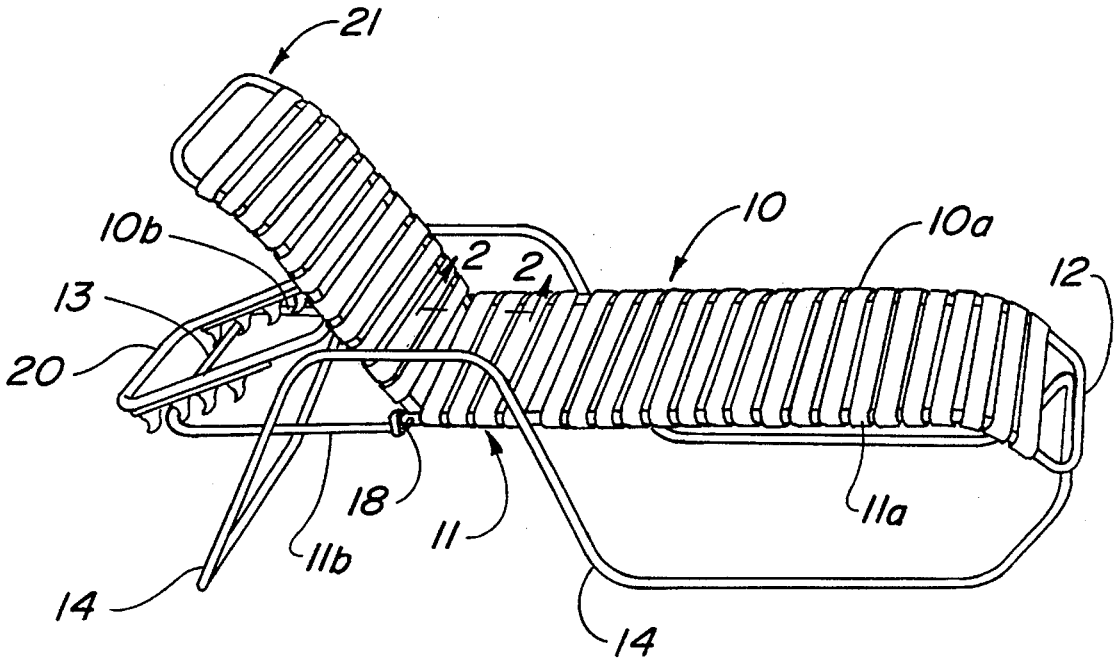
FIG. 1 is a side view of a lounge chair incorporating the features of the present invention.

With reference first to FIG. 1, the chair comprises side frame members 10 and 11, end members 12 and 13 which join the side frame members together and which may be extensions thereof or welded thereto so that the side frame members are held in fixed relationship. In addition, legs or ground supports 14 of various configurations are welded to the side and end frame members. Typically, side and end frame members as well as legs 14 are fabricated of tubular aluminum and joined together as by welding or other suitable means. The tubular members may be of circular, square or rectangular cross-section.

According to the invention, each of the side frame members 10 and 11 are subdivided into a first, elongated raised portion 10*a* and 11*a* for support of the seat and legs of the user and a second, elongated portion 10*b* and 11*b* which is at a lower level relative to the first portion.

In order to join the first and second portions together, the invention provides fittings 16, each of which has a pair of axially extending projections 17 disposed on axes which are substantially parallel to one another and offset from each other on a vertically oriented support member by a predetermined distance, as will be explained hereinafter.

Figure 2:
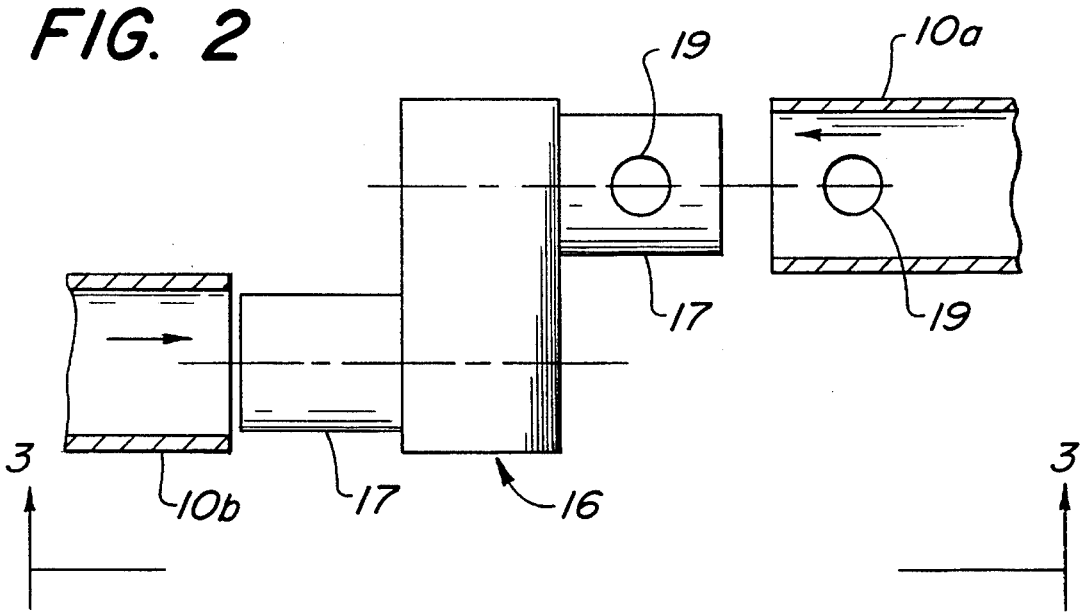
FIG. 2 is an exploded view of an offset bracket of the type used in carrying out the invention taken in the direction shown by line 2—2 with the tubular members shown in section for clarity of illustration.
Figure 3:
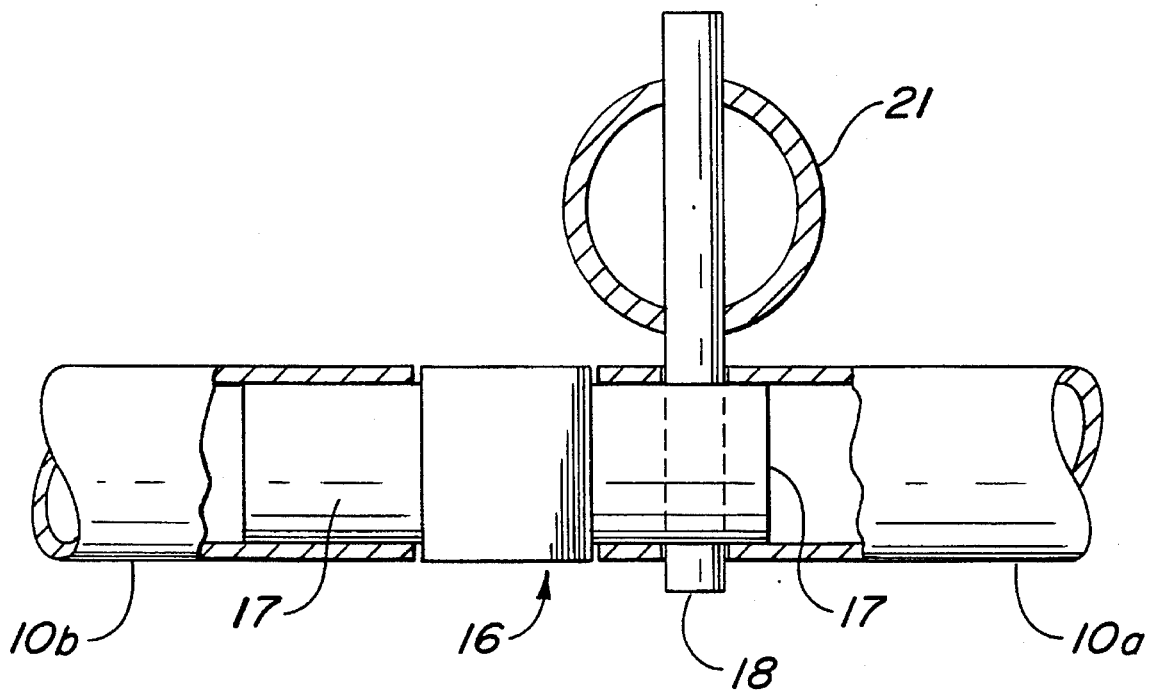
FIG. 3 is a view of the offset bracket seen from below showing the bracket in assembled relationship with the tubular members, the tubular members shown in section for clarity of illustration.

As can best be seen in FIG. 2, the upper most projection 17 fits within the opening in raised tubular portions 10*a* and 11*a*, one of which is shown in FIG. 2. The lower most projection 17 fits within tubular portion 10*b* and 11*b*. Preferably, the projections are secured within the openings in the tubular members as by welding, although other fastening means may be employed. Each projection has a cross-section equal to the cross-section of the tubular portion with which it fits.

In order to pivotally mount the back support 21 to the side frame members, pivot pins 18 are passed through drilled openings 19 extending through the upper frame portions 10*a* and 11*a* and upper projections 17. The pivot pins likewise pass through the ends of the frame of the back support allowing the back support to pivot from a fully extended position in which the back is generally upright and a position in which the back is substantially horizontal. Desirably, the back support is also provided with a pivotally mounted rachet frame 20 which allows for several positions of adjustment in a known manner. In the reclined position of the back support 21, the rachet frame 20 maintains the back support in a substantially horizontal position. In this position, the vertical offset of the side frame members as provided by the vertically offset bosses 17 maintains a clearance space between the back support and the side frame portions 10*b* and 11*b* sufficient to avoid pinching of the fingers of the user of the chair.

In summary, owing to the offset provided by the fittings joining the upper and lower side frame portions, when the seat is in the fully reclined position, sufficient space exists so that pinching of the fingers of the user of the chair is avoided should the fingers be placed between the back support and the lower side frame portions when the back is reclined. By using fittings 16, sharp bends in the tubular side frame members can be avoided producing a substantially stronger construction then would be the case where the tubing was bent at the pivot axis for the back support.

I claim:

1. In a lounge chair having a substantially rectangular base frame comprised of elongated side frame members and end members interconnecting the side frame members, said lounge chair further comprising an adjustable back support on the frame positioned at a location intermediate the end members, the back support being movable between a generally upright position and a reclined position;

said side frame members each being subdivided into a first raised portion and a second lowered portion, the first and second portions having axially opening receptacles facing generally towards each other;

means for connecting the back support to the side frame members comprising a fitting for each said frame member, each said fitting having a pair of axial projections disposed on parallel axes offset from each other and extending in opposite directions;

each of said axial projections of a fitting being fixedly secured within one of said facing receptacles, and hinge means for the back support comprising pivot pins passing through the receptacles of the first raised portions and the projections secured within the receptacles; and the offset between the projections of each fitting being of sufficient magnitude to create a vertical clearance space between the back support and the second, lowered portions of the side frame members, said clearance space being sufficient to prevent injury to the fingers of a user of the lounge chair when the back support is moved to the reclined position.

2. A lounge chair according to claim 1, wherein said side frame members are tubular.

3. A lounge chair according to claim 2, wherein said projections are solid members.

4. A lounge chair according to claim 3, wherein said fitting further comprises a vertically oriented member interconnecting each of said projections.

5. A lounge chair according to claim 4, further including support means between the frame and the back support for limiting movement of the back support beyond a substantially horizontal position.

* * * * *